US009169097B2

(12) United States Patent
Kuchar et al.

(10) Patent No.: US 9,169,097 B2
(45) Date of Patent: Oct. 27, 2015

(54) APPARATUS TO DEPLOY AND EXPAND WEB MATERIAL

(75) Inventors: Matthew J. Kuchar, Metuchen, NJ (US); David M. Kuchar, Metuchen, NJ (US)

(73) Assignee: Kucharco Corporation, Metuchen, NJ (US)

( * ) Notice: Subject to any disclaimer, the term of this patent is extended or adjusted under 35 U.S.C. 154(b) by 592 days.

(21) Appl. No.: 12/943,822

(22) Filed: Nov. 10, 2010

(65) Prior Publication Data

US 2013/0256448 A1 Oct. 3, 2013

Related U.S. Application Data

(60) Provisional application No. 61/260,807, filed on Nov. 12, 2009.

(51) Int. Cl.

| | |
|---|---|
| ***B65H 75/18*** | (2006.01) |
| ***B65H 23/00*** | (2006.01) |
| ***B65H 23/10*** | (2006.01) |
| ***B65H 16/00*** | (2006.01) |

(52) U.S. Cl.

CPC ..... *B65H 23/00* (2013.01); *B65H 16/005* (2013.01); *B65H 23/10* (2013.01); *B65H 2301/41462* (2013.01); *B65H 2301/44921* (2013.01); *B65H 2301/5126* (2013.01)

(58) Field of Classification Search

USPC ..... 242/597, 597.7, 597.8, 580, 580.1, 579, 242/585

See application file for complete search history.

(56) References Cited

U.S. PATENT DOCUMENTS

| | | | | |
|---|---|---|---|---|
| 347,324 | A | 8/1886 | Cramer | 229/120.4 |
| 1,895,642 | A | 1/1933 | Preble | 55/487 |
| 2,037,164 | A | 4/1936 | Harrah | 55/489 |
| 2,319,225 | A | 5/1943 | Grebe et al. | 52/670 |
| 2,493,726 | A | 1/1950 | O'Day | 55/443 |
| 2,558,185 | A | 6/1951 | Leisen | 55/520 |
| 2,602,521 | A | 7/1952 | Smith | 55/487 |
| 2,989,145 | A | 6/1961 | Goodloe | 55/443 |
| 3,040,968 | A | 6/1962 | Long et al. | 229/87.08 |
| 3,067,039 | A | 12/1962 | Crane | 426/106 |
| 3,069,067 | A | 12/1962 | Crane | 229/87.08 |
| 3,080,579 | A | 3/1963 | Gordon | 267/103 |
| 3,109,579 | A | 11/1963 | Crane | 229/87.08 |
| 3,245,606 | A | 4/1966 | Crane | 383/103 |
| 3,346,246 | A | 10/1967 | Loetel et al. | 261/103 |
| 3,407,550 | A | 10/1968 | Shaw | 52/101 |
| 3,423,042 | A * | 1/1969 | Lipfert | 242/421.5 |
| 3,550,842 | A | 12/1970 | Scholz | 229/87.08 |
| 3,603,369 | A | 9/1971 | Scholz | 229/87.08 |
| 3,655,501 | A | 4/1972 | Tesch | 428/136 |
| 3,744,222 | A | 7/1973 | Delao | 55/446 |
| 3,762,629 | A | 10/1973 | Bruno | 229/87.08 |

(Continued)

*Primary Examiner* — William A Rivera

(74) *Attorney, Agent, or Firm* — Ernest D. Buff & Assoc. LLC; Ernest D. Buff; Margaret A. LaCroix

(57) ABSTRACT

A dispenser expands paper web material by controlling the tracking of off-winding paper and holding it in place. Pulling the paper from one direction expands it in all directions simultaneously. The dispenser has a base, a mast, a cantilevered axle that holds a roll of cut paper web material for off-winding, and a roller assembly that controls the tracking of the off-wind paper web material and holds it in place. Advantageously, upon being pulled in one direction, the paper web material expands in all directions simultaneously in an efficient and reliable manner.

10 Claims, 43 Drawing Sheets

(56) References Cited

U.S. PATENT DOCUMENTS

| | | | | | |
|---|---|---|---|---|---|
| 3,825,465 | A | | 7/1974 | Stock | 428/135 |
| 3,839,525 | A | * | 10/1974 | Doll | 264/154 |
| 3,958,751 | A | | 5/1976 | Bruno | 229/87.08 |
| 3,966,044 | A | | 6/1976 | Cunningham | 206/427 |
| 4,136,771 | A | | 1/1979 | Owen | 206/150 |
| 4,170,691 | A | | 10/1979 | Rogers | 428/572 |
| 4,306,675 | A | | 12/1981 | Swanson | 229/120.07 |
| 4,501,707 | A | | 2/1985 | Buhlmann | 261/94 |
| 4,997,721 | A | | 3/1991 | Shaw et al. | 428/557 |
| 5,244,715 | A | | 9/1993 | Kuchar | 428/195.1 |
| 5,252,111 | A | | 10/1993 | Spencer et al. | 55/489 |
| 5,500,271 | A | | 3/1996 | Pasch et al. | 428/135 |
| 5,575,435 | A | * | 11/1996 | Sperry et al. | 242/421.4 |
| 5,691,032 | A | | 11/1997 | Trueblood et al. | 428/136 |
| 6,929,843 | B2 | * | 8/2005 | Kuchar | 428/136 |
| 7,331,542 | B2 | * | 2/2008 | Cocciadiferro et al. | 242/597 |

* cited by examiner

APPARATUS TO DEPLOY AND EXPAND WEB MATERIAL

CROSS REFERENCE TO RELATED APPLICATIONS

This Present Application is the non-provisional counterpart of U.S. Provisional Patent Application Ser. No. 61/260,807 filed on Nov. 12, 2009. The Present Application claims the benefit of and priority to said Provisional Patent Application which is incorporated herein by reference in its entirety. The Present Application is also related to my U.S. Pat. No. 6,929,843, issued on Aug. 16, 2005, entitled Fence Tape, which is also incorporated by reference herein in its entirety. Said US patent is hereinafter referred to as the Fence Tape Patent.

BACKGROUND OF THE INVENTION

My Fence Tape Patent discloses a web material cut in such a manner that when pulled in both the longitudinal and transverse directions, a fence type barrier is formed. The web material is normally plastic or any resinous woven or non-woven material. One useful embodiment is to fabricate the web from paper. In this configuration, it is extremely useful as a packing material due to its spring-like cushioning and expansive properties. In this embodiment, it is very difficult to deploy the web material by hand simultaneously in the longitudinal and transverse directions so as to produce a large amount of expanded material. The Present Invention is a machine or apparatus to facilitate deployment of this material.

BRIEF DESCRIPTION OF THE DRAWINGS

FIG. 5(*b*) illustrates an exploded isometric view of the base with the footings and wheels separate from the base.

FIG. 5(*c*) illustrates a side elevation view of the base without wheels or vertical mast.

FIG. 13(*b*) is a photograph showing a side elevation view of the top of the apparatus having the rolling members mounted on top.

FIG. 13(*c*) illustrates the apparatus having the rolling member mounted on top from a different viewing angle than FIG. 13(*b*).

FIG. 14(*b*) illustrates the mounting block halves having through-holes.

FIG. 14(*c*) illustrates a cross section of the mounting block.

FIG. 20(*b*) is a photograph showing the web roll with a plug bushing inserted therein.

FIG. 25(*b*) is a photograph showing the assembled and mounted off-wind axle from a different viewing angle than FIG. 25(*a*).

FIG. 26(*b*) illustrates a front elevation of the rear brake pad.

FIG. 26(*c*) illustrates an isometric view of the rear brake pad.

FIG. 26(*d*) illustrates a top plan view of the rear brake pad.

FIG. 27(*b*) is a photograph of the front of the rear brake pad.

FIG. 27(*c*) is a photograph showing the rear brake pad from the top.

FIG. 30(*b*) illustrates a top plan view of the front brake block.

FIG. 30(*c*) illustrates a front elevation of the front brake block.

FIG. 30(*d*) illustrates a side elevation of the front brake block.

DETAILED DESCRIPTION OF THE INVENTION

Figure 1:
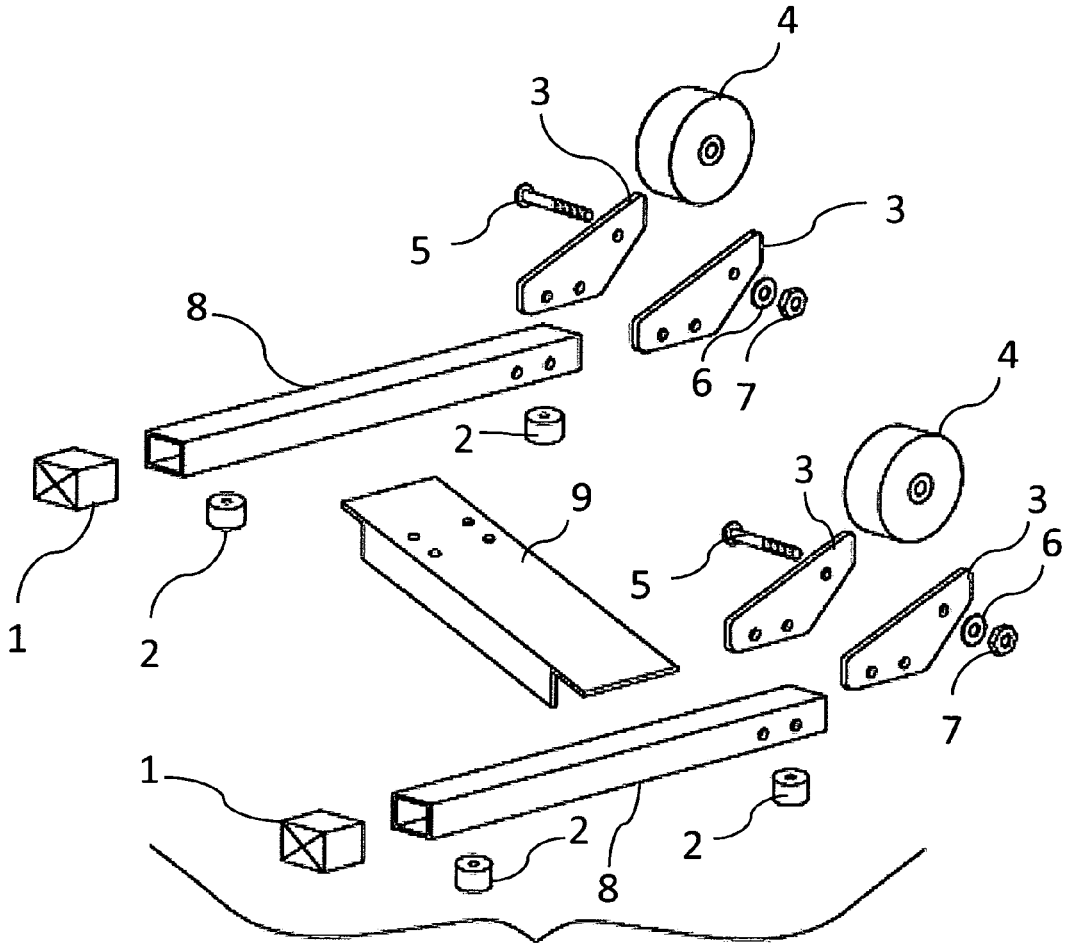
FIG. 1 is an exploded view of the components of the base of the apparatus prior to assembly.
Figure 2:
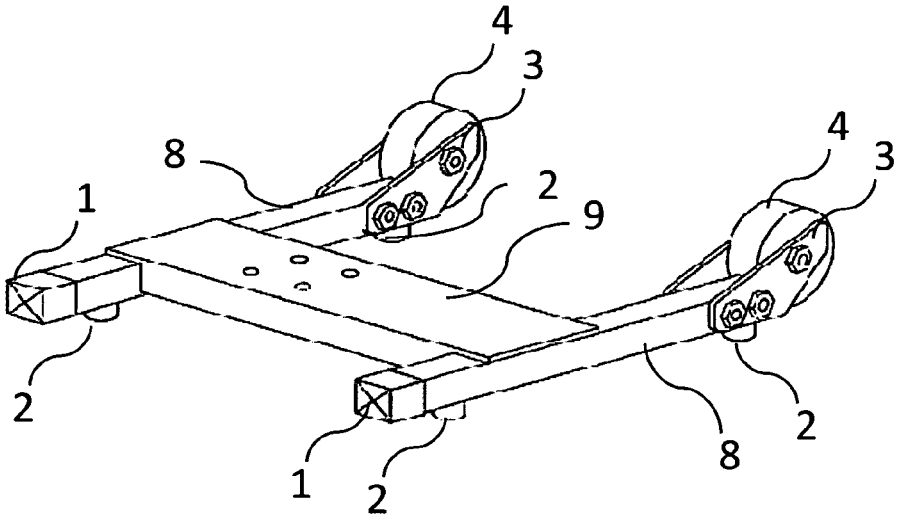
FIG. 2 shows the assembled base of the apparatus.

The device essentially comprises a base, a mast, a cantilevered axle that holds the roll of cut paper for off-winding, and a roller assembly that controls the tracking of the off-wind paper and holds it in place such that pulling the paper from one expands it in all directions simultaneously. FIG. 1 is an exploded view of the components of the base of the apparatus prior to assembly. FIG. 2 shows the assembled base of the apparatus. The base comprises:

- two tubes 8;
- two vinyl end caps 1 that cover the tube openings, respectively;
- four rubber feet 2 secured to the tubes;
- four tube extensions 3 to mount two caster wheels 4 having internal bearings;
- two axle bolts 5 for securing the caster wheels 4, each axle bolt further utilizing a washer 6 and a nut 7;
- a base cross tube 8; and,
- a perpendicular mounting plate base 9 for the mast assembly (not shown).

Figure 3:
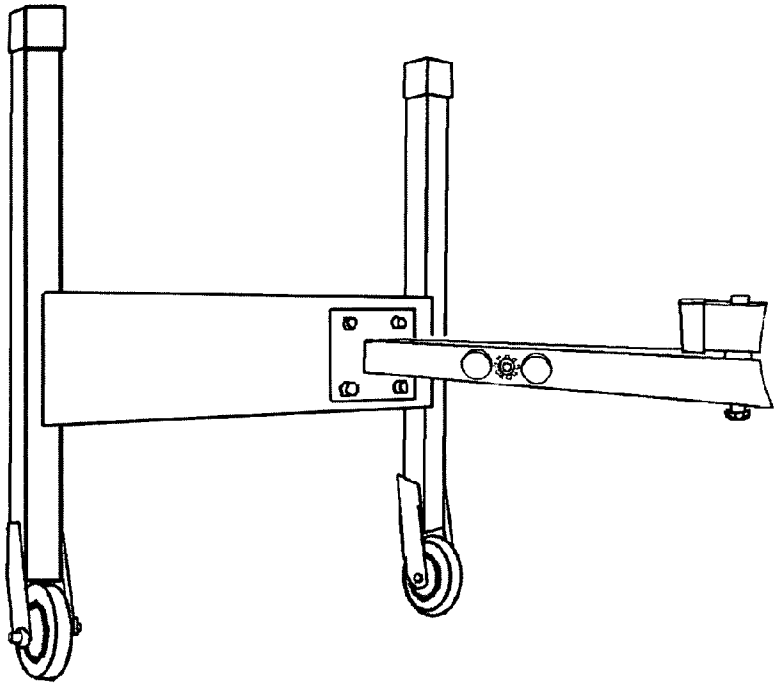
FIG. 3 is a photograph of the base of the apparatus with the vertical mast attached.
Figure 4:
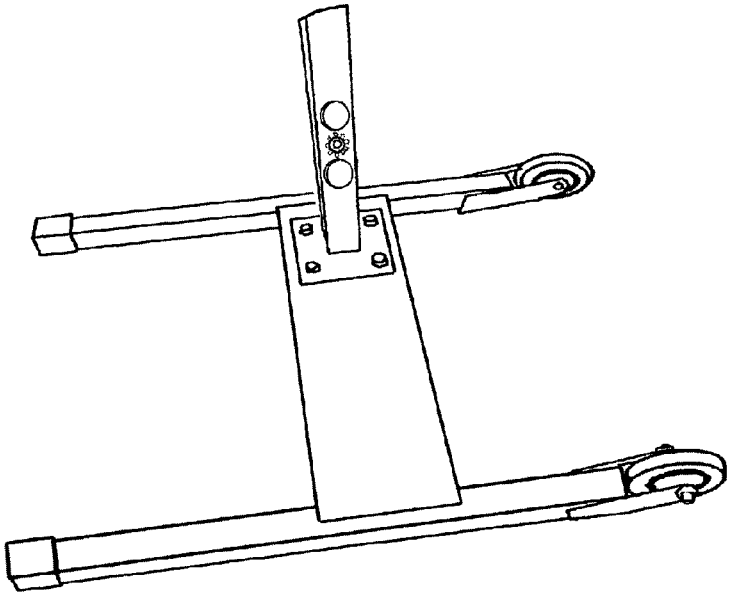
FIG. 4 is a photograph of the base of the apparatus with the vertical mast attached from a different viewing angle than shown in FIG. 3.

As can be surmised from FIG. 2, the apparatus can be rolled along a floor or bottom surface by tilting such that the wheels 4 are free to roll when in contact with the floor. FIG. 3 and FIG. 4 are photographs showing the base of the apparatus with the vertical mast attached.

Figure 5A:
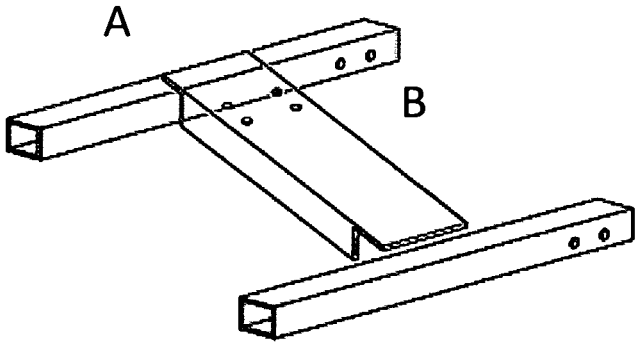
FIG. 5(*a*) illustrates an isometric view of the assembled base not showing the attached wheels.
Figure 5B:
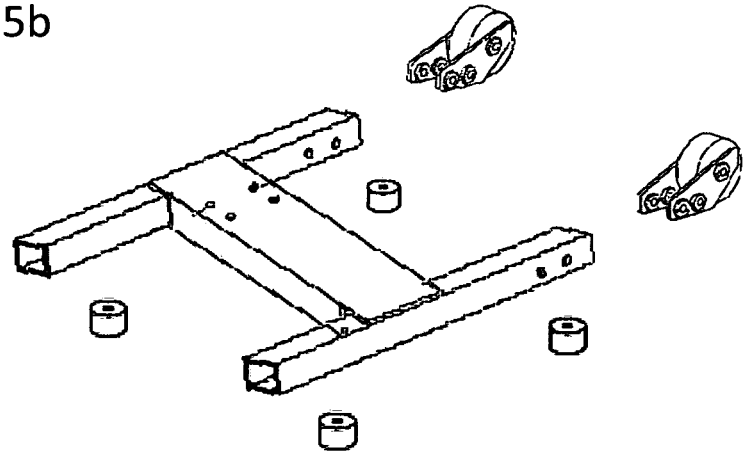
Figure 5C:
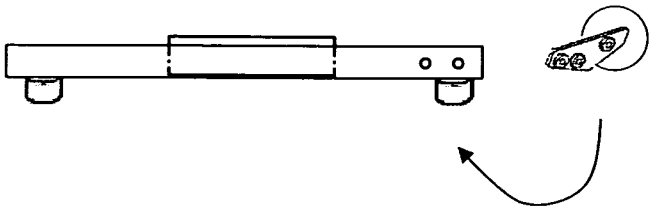
Figure 6:
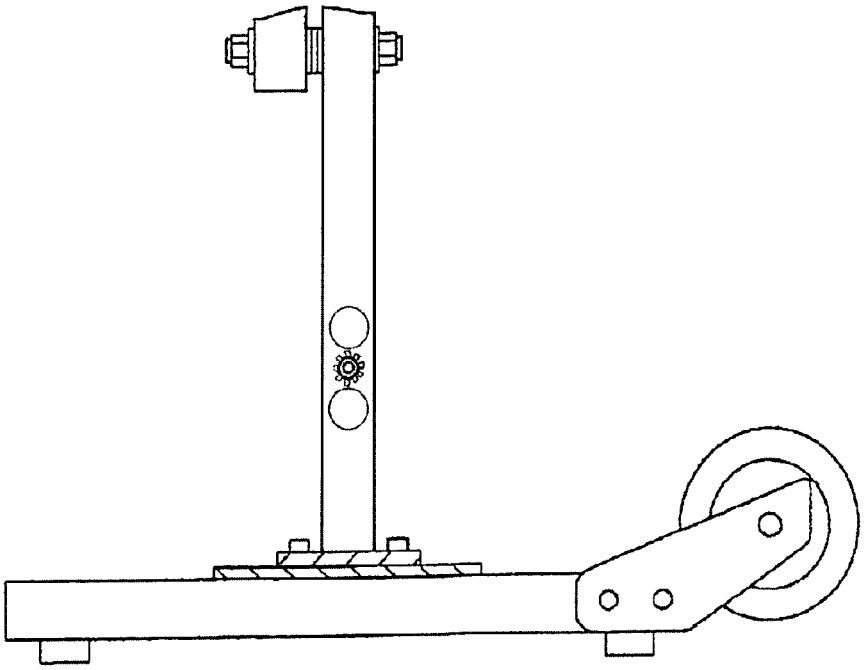
FIG. 6 is a photograph showing a side elevation view of the base with wheels and vertical mast attached.

FIG. 5(*a*) illustrates an isometric view of the assembled base not showing the attached wheels. The apparatus may be fabricated with or without wheels. The cross plate may either be bent of a flat plate. The base may either be bolted or welded together. FIG. 5(*b*) illustrates an exploded isometric view of the base with the footings and wheels separate from the base. If the base is bolted together, the casters are optional. However, they provide mobility for the device. FIG. 5(*c*) illustrates a side elevation view of the base without wheels or vertical mast. It shows the base with optional attachment of the casters and wheels. FIG. 6 is a photograph showing a side elevation view of the base with wheels and vertical mast attached.

Figure 7:
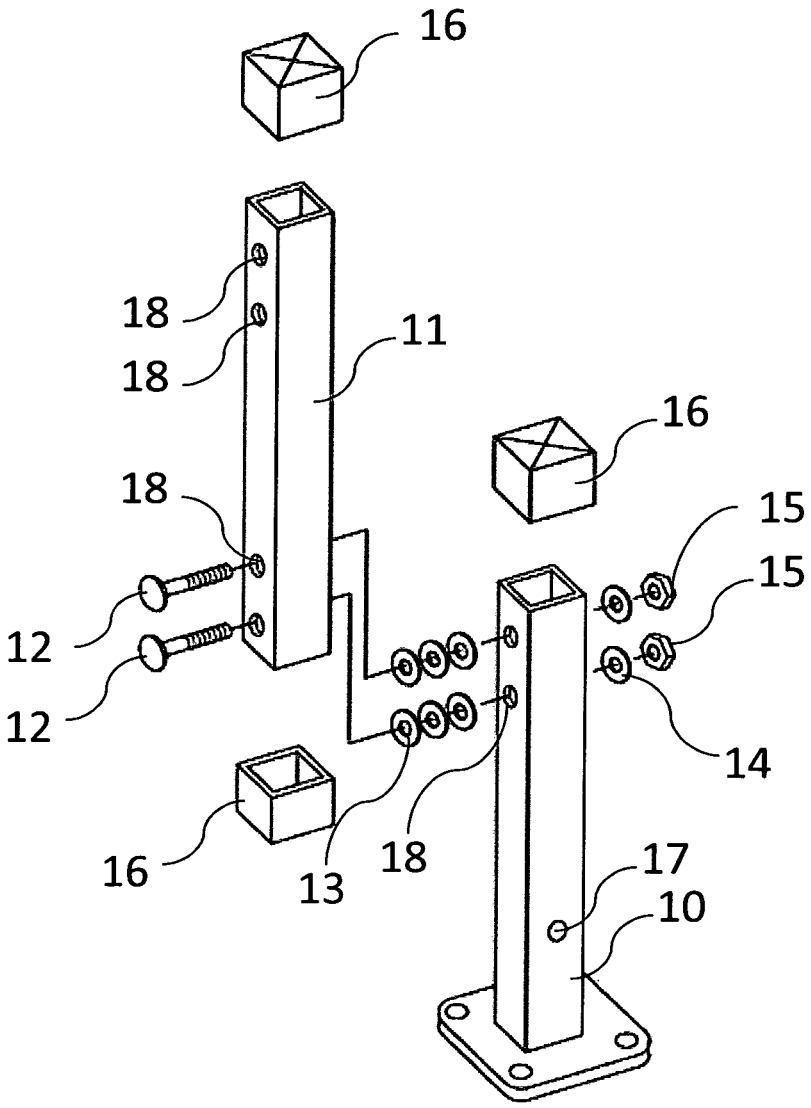
FIG. 7 illustrates an exploded view of the vertical mast.
Figure 8:
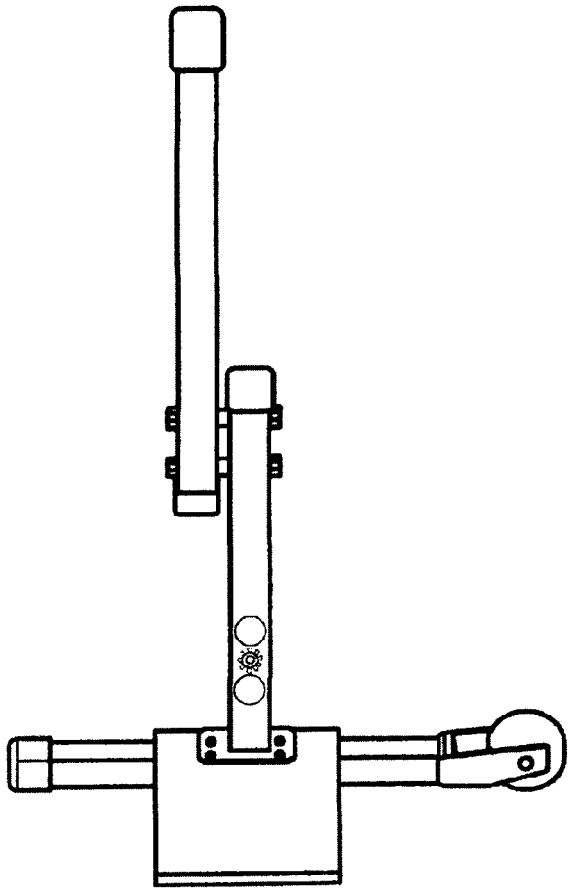
FIG. 8 is a photograph showing the assembled vertical mast.

FIG. 7 illustrates an exploded view of the vertical mast. The mast weldment bottom 10 comprises two welded components, a vertical tube and flange with mounting holes for attachment to base plate 9. Secured to bottom weldment 10 is a mast extension top 11. They are secured to each other using through holes 18A and 18B with two bolts 12, six spacer washers 13, two washers 14, and two nuts 15. Serrated flange nuts are preferred. Three vinyl tubing caps 16 fit to cover open tube ends. A through-mounting hole 17 is in bottom tube 10 to accommodate the off-wind horizontal arm and axle. Through-holes 18C accommodate threaded rods for mounting of the roller assembly. FIG. 8 is a photograph showing the assembled vertical mast.

Figure 9:
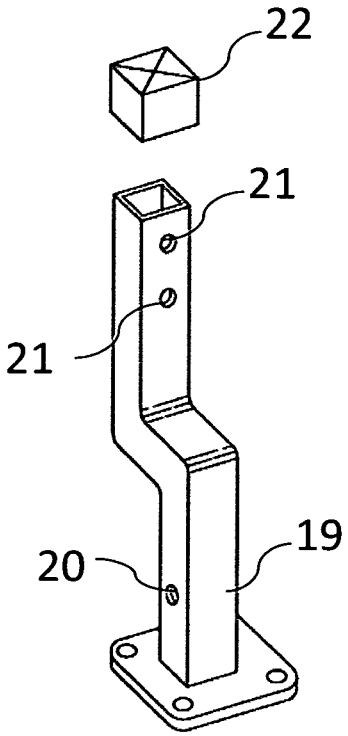
FIG. 9 illustrates an alternate embodiment of the vertical mast manufactured as a single bent member.

FIG. 9 illustrates an alternate embodiment of the vertical mast manufactured as a single bent member 19. This embodiment is a weldment comprising a bent tube with a flange having holes for mounting to plate 9. Through holes 20 accommodate the off-wind axle, and through holes 21 accommodate the threaded rod for the roller assembly.

Figure 10:
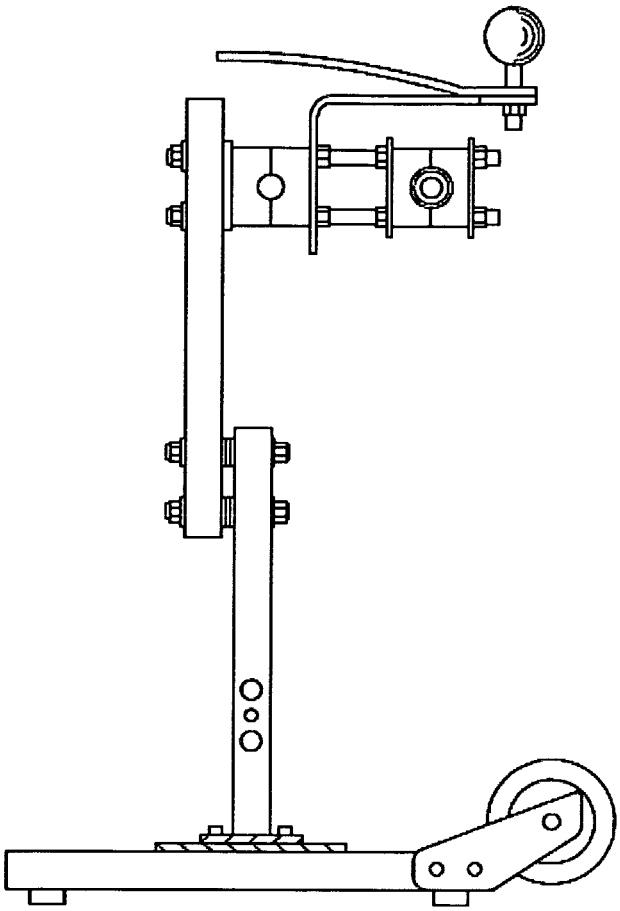
FIG. 10 illustrates a side elevation of the apparatus without the rolling members.
Figure 11:
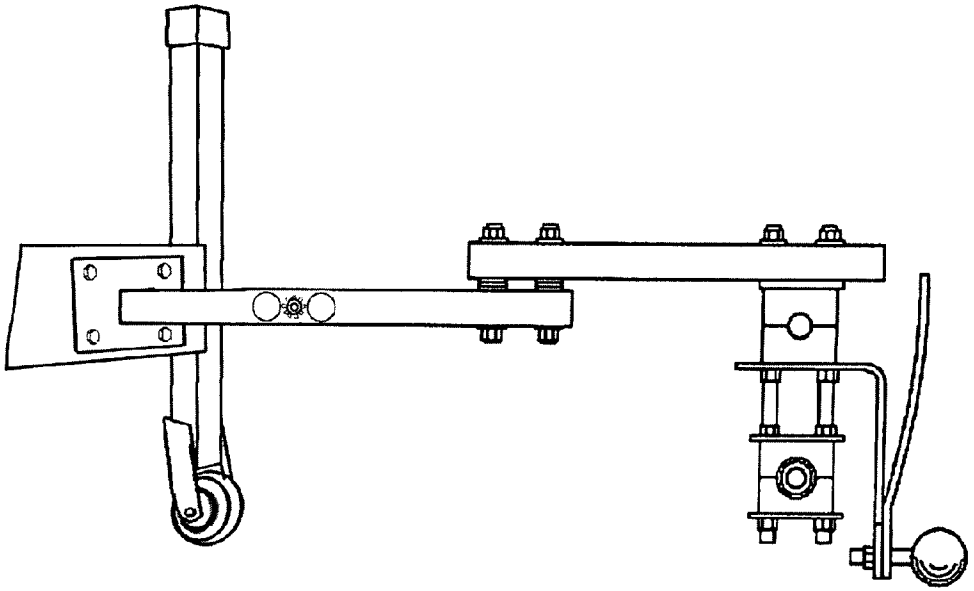
FIG. 11 is a photograph showing the apparatus as depicted in FIG. 10.

FIG. 10 illustrates a side elevation of the apparatus without the rolling members. FIG. 11 is a photograph showing the apparatus as depicted in FIG. 10. The mast assembly is mounted vertically and perpendicular to the horizontal base assembly. The roller assembly is attached horizontally and perpendicular to the mast assembly at its top. Threaded rods mount the roller assembly to the top of the mast as shown. Mounting blocks shown in FIG. 14 having through holes are secured to a threaded boss backup plate having threaded holes Attached to and flush with the mounting blocks is a bent arm having through holes. At one end of the arm, a knob is attached to facilitate tilting and rolling the unit. However, it has a dual function of holding in place a flat spring that holds the paper in place against the tracking wheel. It serves as a stay to prevent displacement of the paper web material to control tracking. Attached to the ends of the threaded rods are similar mounting blocks as those shown in FIG. 14. The mounting blocks hold axles, and can be loosened for horizontal axle adjustment. The leftmost mounting blocks accommodate the axle for the tracking wheel. The rightmost mounting blocks accommodate the axle for the pinch roller. The pressure of the pinch roller against the tracking wheel can be adjusted with the threaded rods, or they may be spring loaded to maintain adjustment over longer periods. Foam rubber springs are placed on the on the mast bottom tube 10 to allow braking the off-wind roll.

Figure 12:
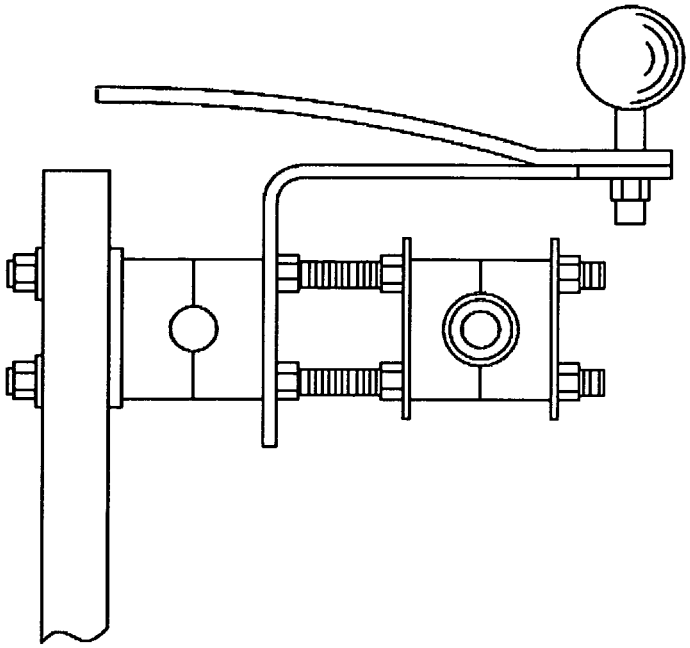
FIG. 12 is a photograph showing a side elevation of the top of the apparatus.
Figure 13A:
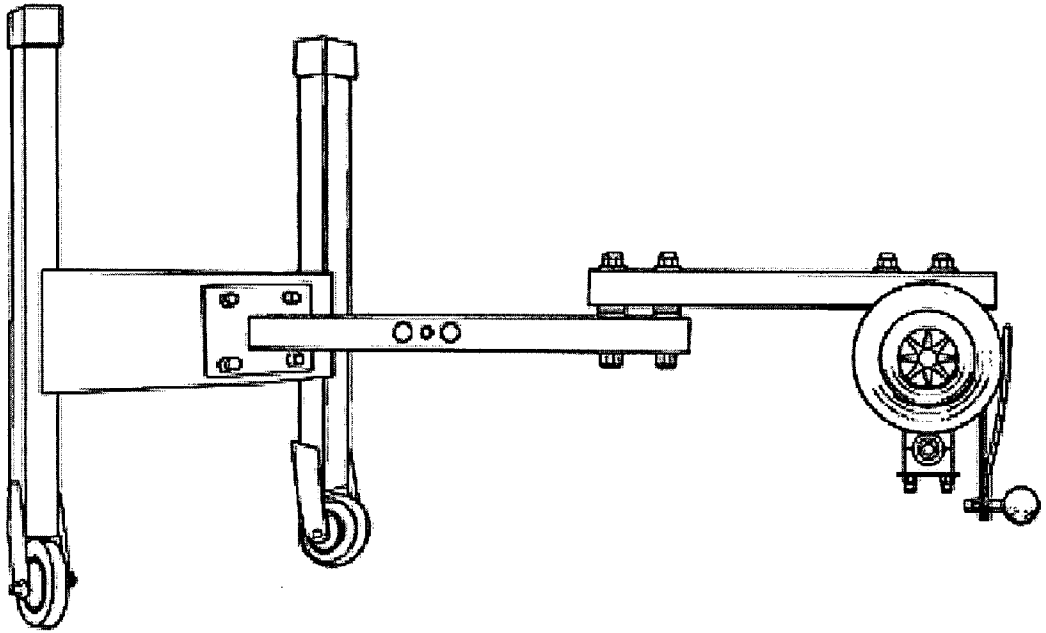
FIG. 13(*a*) is a photograph showing a side elevation of the apparatus with the rolling members mounted on top.
Figure 13B:
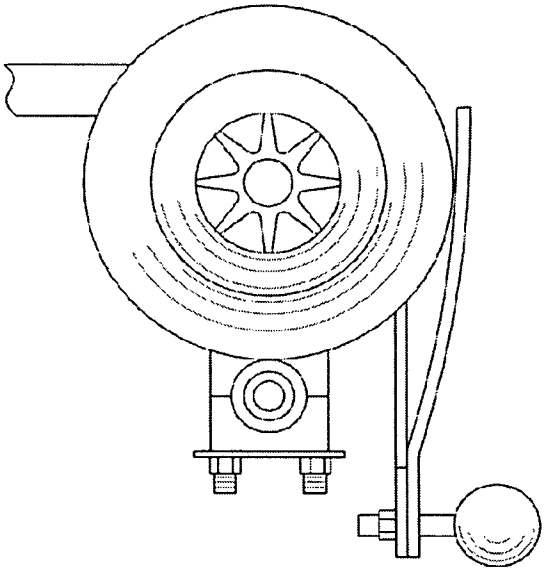
Figure 13C:
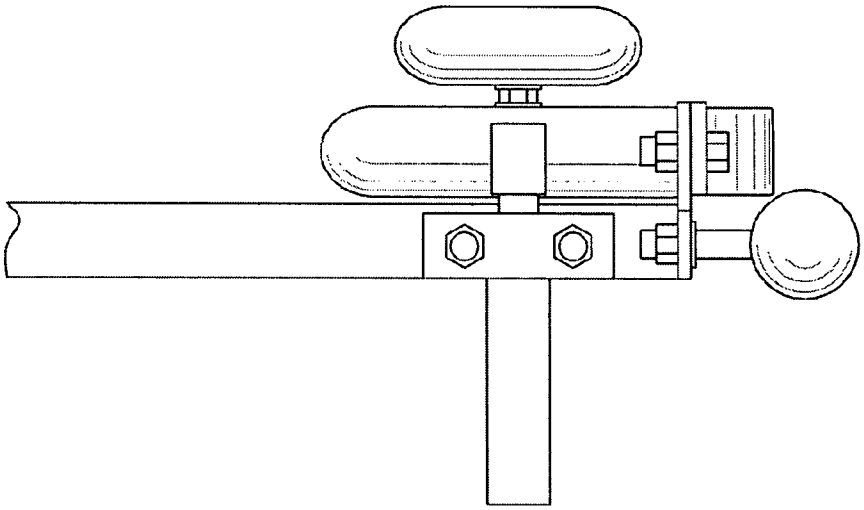

FIG. 12 shows a side elevation of the top of the apparatus. It shows the top of the apparatus as described for FIG. 10. FIG. 13(*a*) shows a side elevation of the apparatus with the rolling members mounted on top. FIG. 13(*b*) shows a side elevation view of the top of the apparatus having the rolling members mounted on top. There are three ball bearing rollers:

- a large rubber tracking roller;
- a smaller secondary roller; and
- a small metal pinch roller.

FIG. 13(*b*) shows the tracking roller on the left, the secondary roller in front of the tracking roller, and the pinch roller on the right. The tracking roller is tangent to the pinch roller. FIG. 13(*c*) illustrates the apparatus having the rolling member mounted on top from a different viewing angle than FIG. 13(*b*). In the viewing angle shown in FIG. 13(*c*) the secondary roller is shown on the left and the tracking roller on the right with the pinch roller in front of the tracking roller.

Figure 14A:
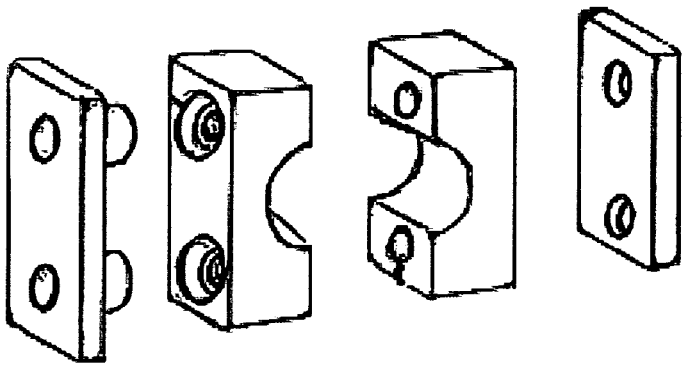
FIG. 14(*a*) illustrates an exploded view of the mounting block halves for the tracking wheel and pinch roller.
Figure 14B:
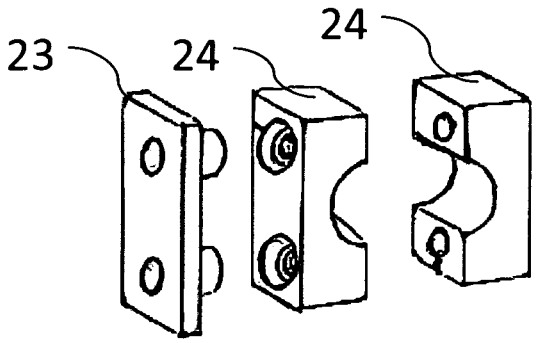
Figure 14C:
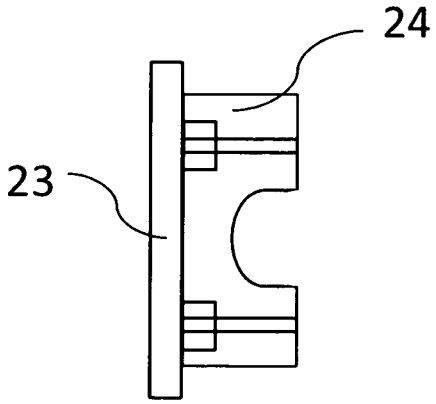

FIG. 14(*a*) illustrates an exploded view of the mounting block halves for the tracking wheel and pinch roller. FIG. 14(*b*) illustrates the mounting block halves having through-holes. FIG. 14(*c*) illustrates a cross section of the mounting block. The basic mounting block comprises two identical halves having through holes. When joined together, a cylindrical opening allows a shaft or axle to be inserted perpendicular to the block assembly. A bushing could be used to house a smaller shaft if necessary. The through holes are slightly enlarged as shown on the left block half in FIG. 14(*a*). A boss backup plate (shown leftmost in FIG. 14(*a*)) comprises threaded through holes passing through two enlarged bosses. The holes on the half block are oversized so that the bosses may be inserted therein in a close fit. The end plate (shown rightmost in the figure) has two through holes, also slightly oversized. FIG. 14(*b*) illustrates the through holes in the block halves as dashed lines. In the cross section shown in FIG. 14(*c*), the bosses of backup plate 23 are shown inserted into the through holes of half block 24.

Figure 15:
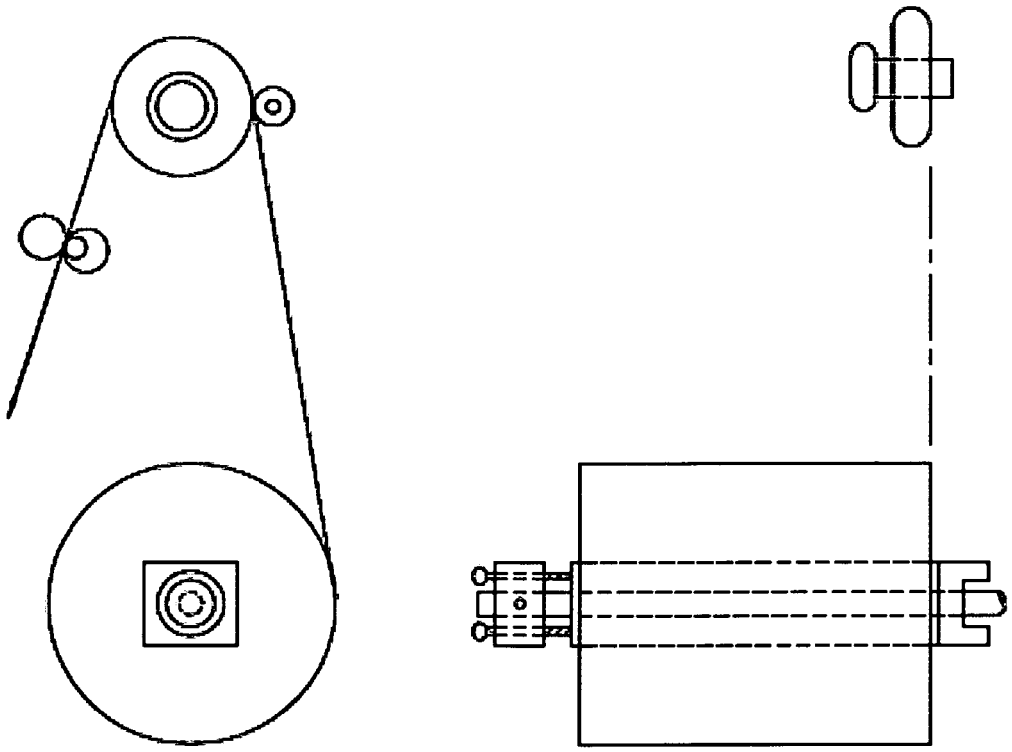
FIG. 15 illustrates a side elevation and rear elevation of the web path and tracking.
Figure 16:
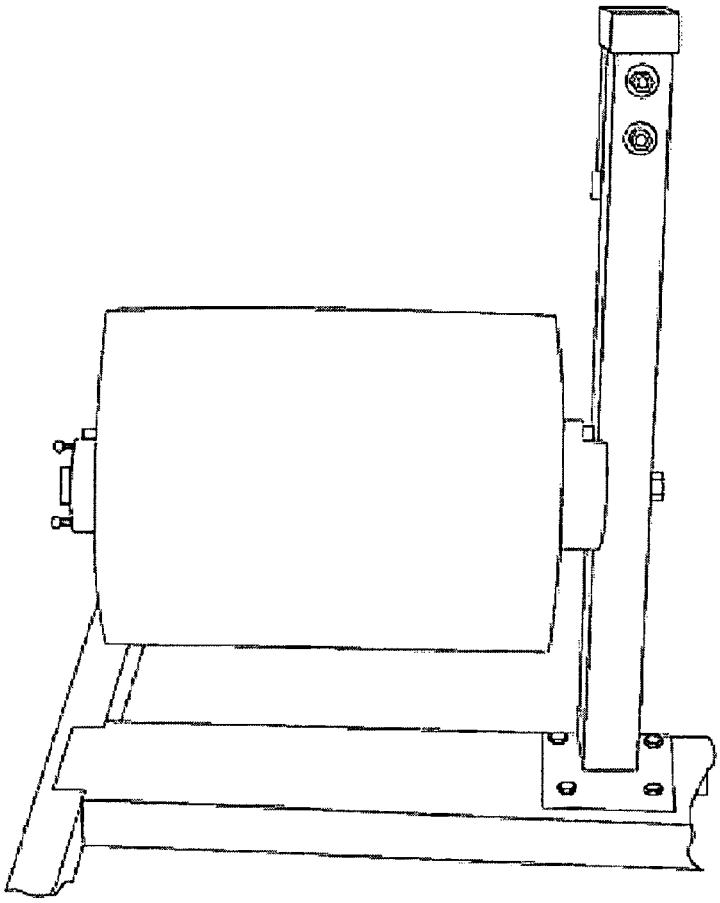
FIG. 16 is a photograph shows the web roll mounted on the off-wind axle.

FIG. 15 illustrates a side elevation and rear elevation of the web path and tracking. The side elevation shows the path of the web as it leaves the off-wind roll and travels upward and between the tracking roller and the pinch roller and thereafter. The secondary helper roller keeps the web in proximity to the pinch roller, and helps to ease opening the expanded web material. Note the spring keeper that holds the web in place at the top of the tracking roller. In the rear elevation, the web path is slightly to the right of the center line of the tracking wheel to prevent the web from falling off the tracking wheel. The brake mechanism uses the cap plug bushing rim of the web roll (shown in FIG. 19) between the front and back of the brake pad and plastic block by compressing the plastic block and pin against the foam rubber springs mounted on the mast. FIG. 16 is a photograph shows the web roll mounted on the off-wind axle.

Figure 17:
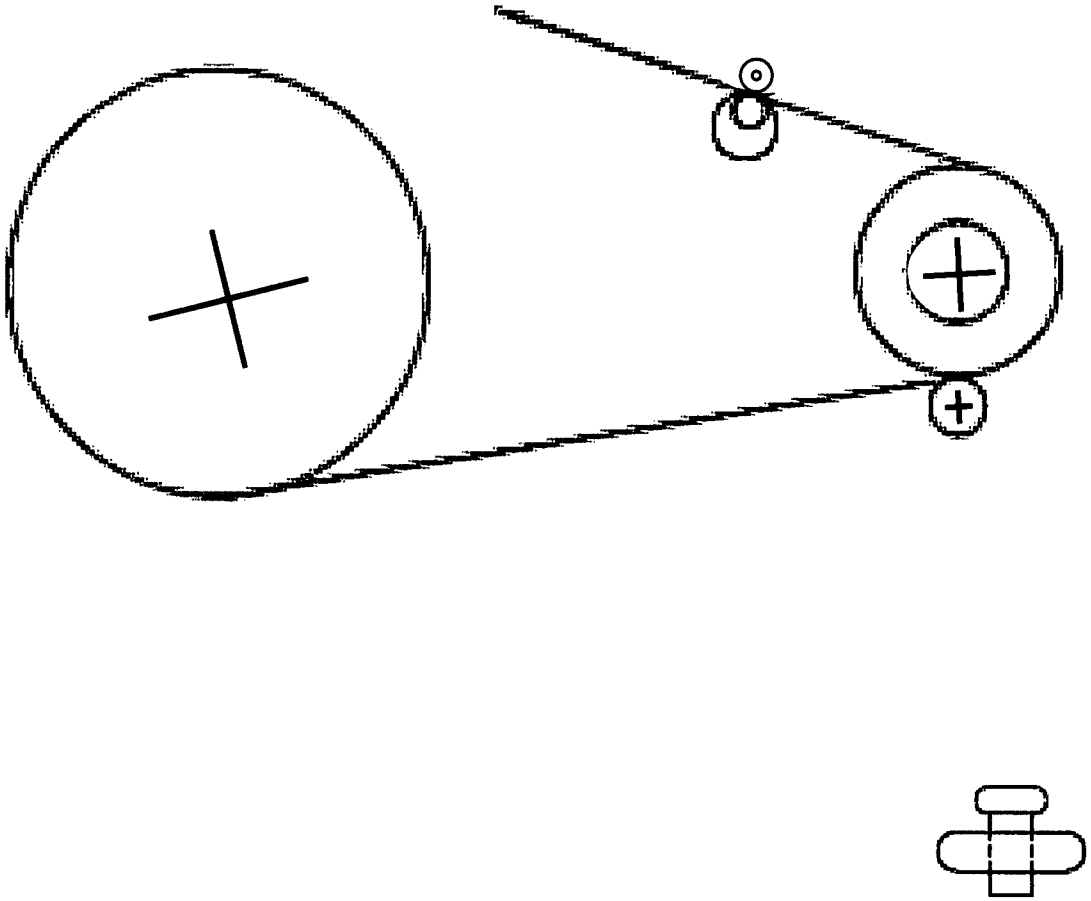
FIG. 17 illustrates a side elevation of the web path of a motor and pinch roll assembly.
Figure 18:
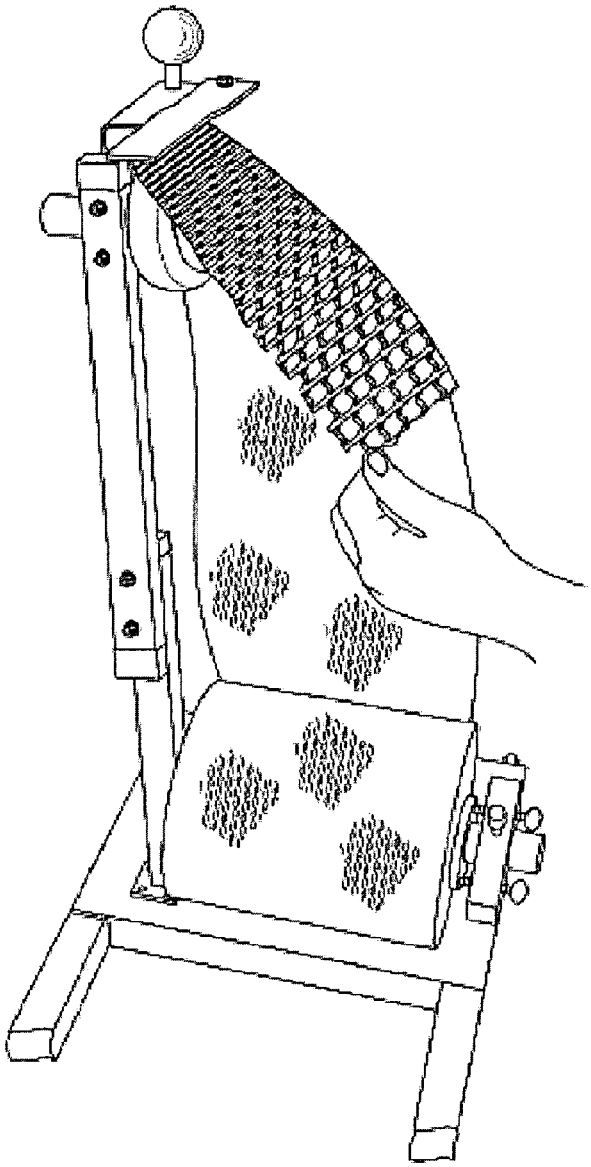
FIG. 18 is a photograph showing the web roll threaded into the rollers.

FIG. 17 illustrates an alternate embodiment where a motor is used to deploy the web material instead of deploying by hand. The figure illustrates a side elevation of the web path of a motor and pinch roll assembly. FIG. 18 is a photograph showing the web roll threaded into the rollers. The photograph shows an operator preparing to deploy the material.

Figure 19:
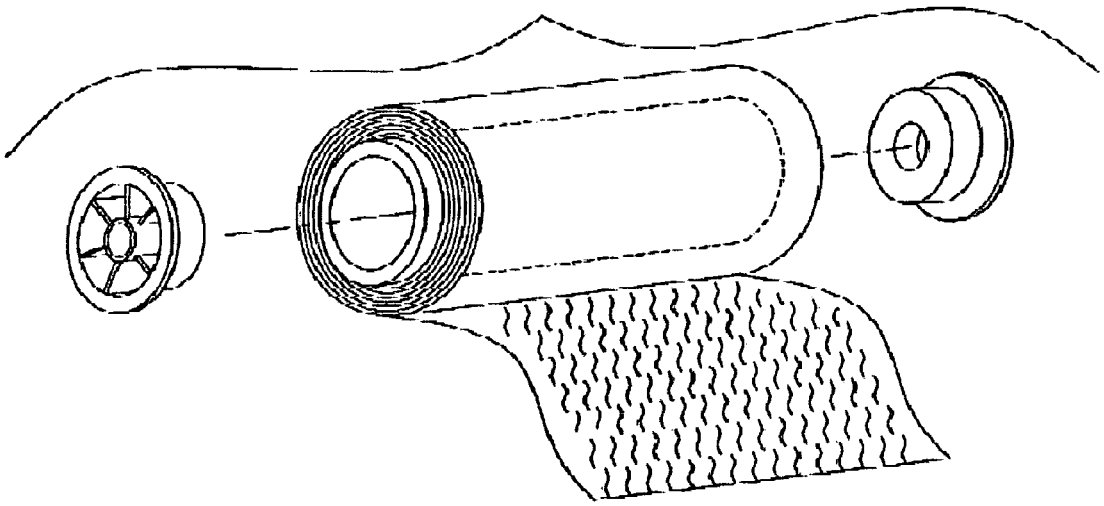
FIG. 19 illustrates an isometric view of the web roll with the cap plug bushings.
Figure 20A:
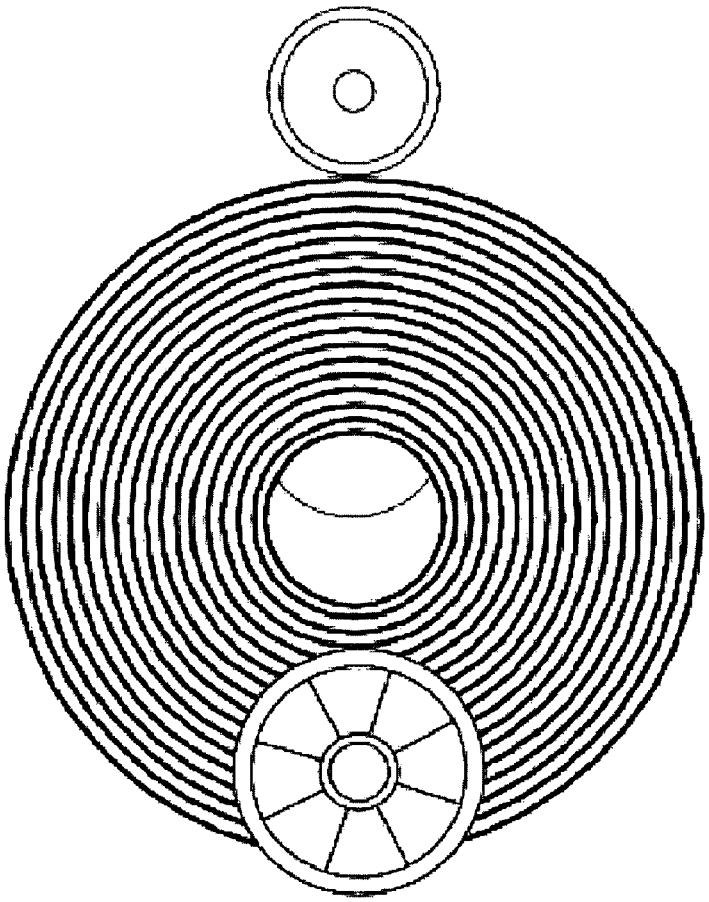
FIG. 20(*a*) is a photograph showing the web roll and cap plug bushings.
Figure 20B:
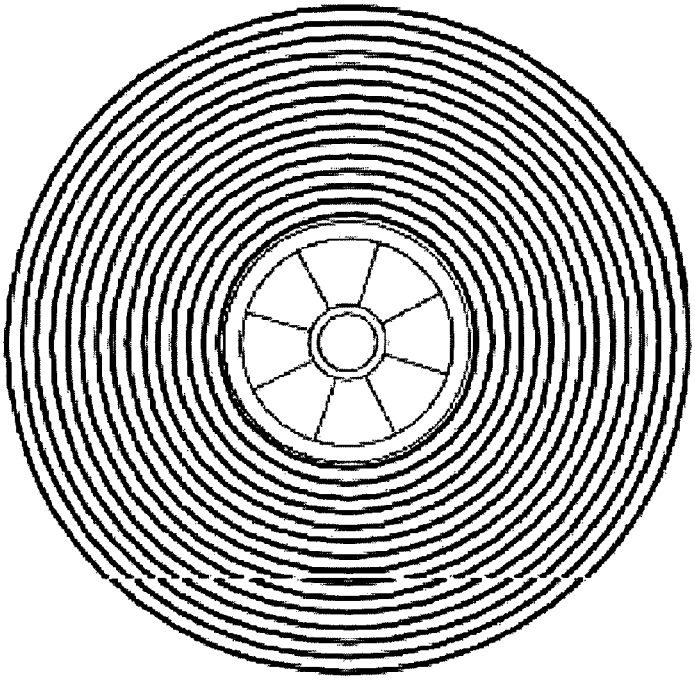

FIG. 19 illustrates an isometric view of the web roll with the cap plug bushings. The cap plug bushings fit securely into the cardboard tube ends. The plastic bushings permit the rear brake pad on the mast side and the nose or front brake block assembly to engage the cap plug bushings. All parts are supported from the off-wind axle. FIG. 20(*a*) is a photograph showing the web roll and cap plug bushings. FIG. 20(*b*) is a photograph showing the web roll with a plug bushing inserted therein.

Figure 21:
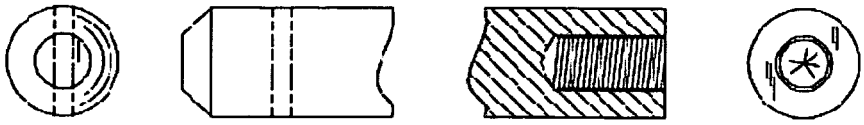
FIG. 21 illustrates a broken exploded cross section of the off-wind axle.
Figure 22:
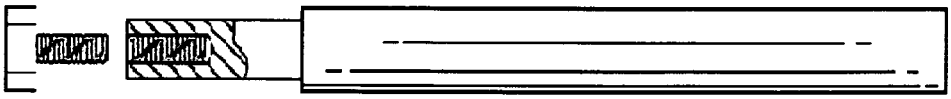
FIG. 22 illustrates a cross section of the tracking wheel axle.
Figure 23:
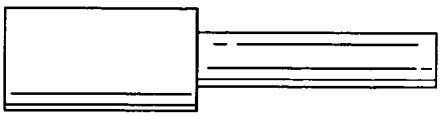
FIG. 23 illustrates a side elevation of the pinch roll axle and roller.
Figure 24:
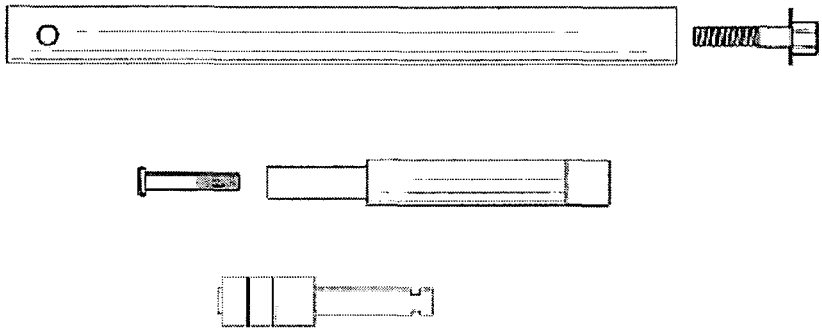
FIG. 24 is a photograph showing the components of the off-wind axle, the tracking wheel axle, and the pinch roll axle and roller arranged as in FIGS. 21, 22, and 23.
Figure 25A:
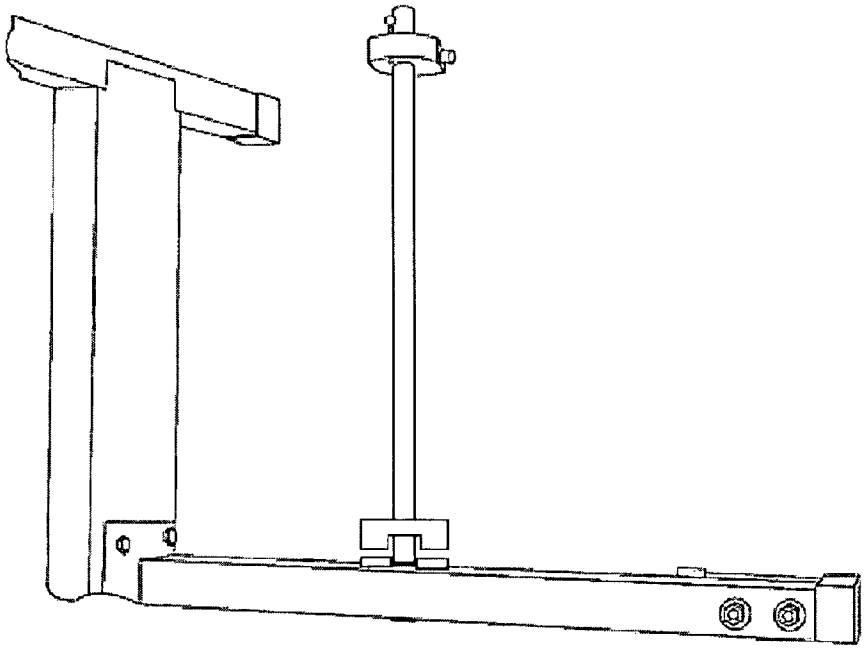
FIG. 25(*a*) is a photograph showing a side elevation of the off-wind axle completely assembled and mounted on the apparatus.
Figure 25B:
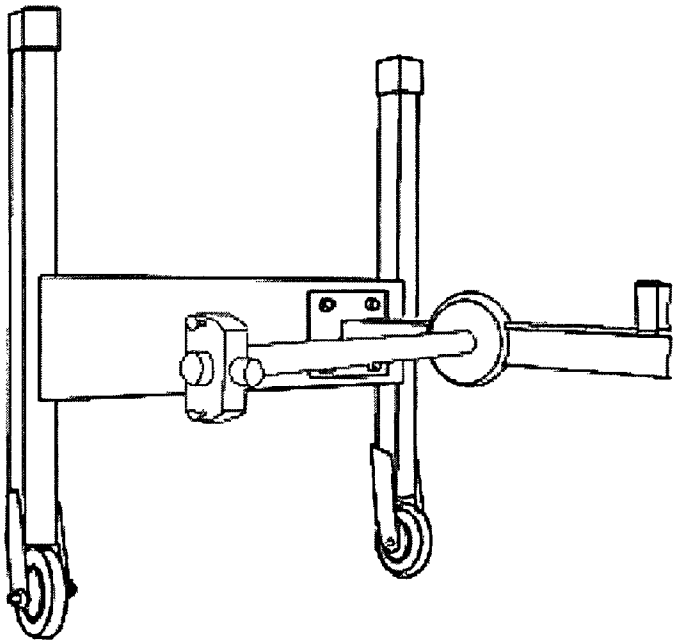
Figure 26A:
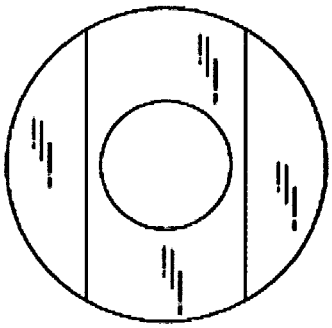
FIG. 26(*a*) illustrates a rear elevation of the rear brake pad.
Figure 26B:
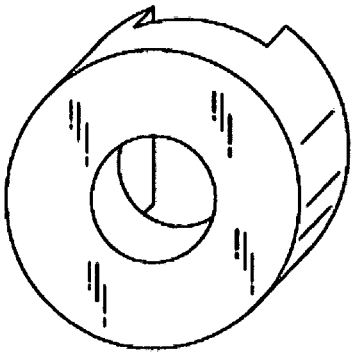
Figure 26C:
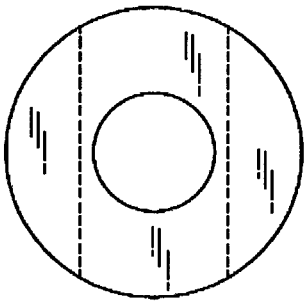
Figure 26D:
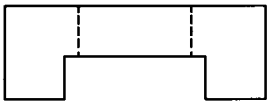
Figure 27A:
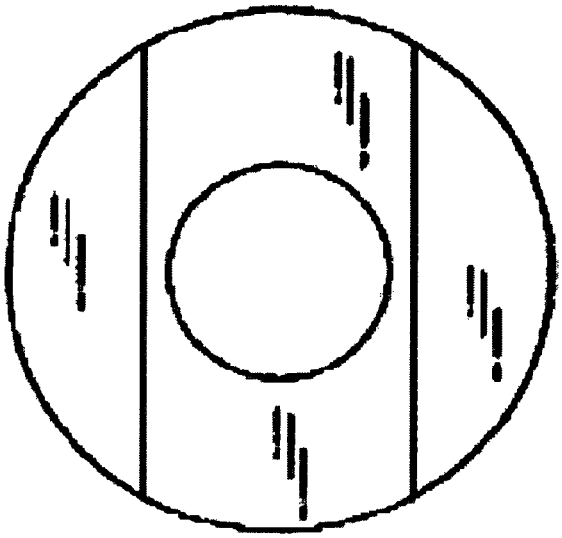
FIG. 27(*a*) is a photograph of the back of the rear brake pad.
Figure 27B:
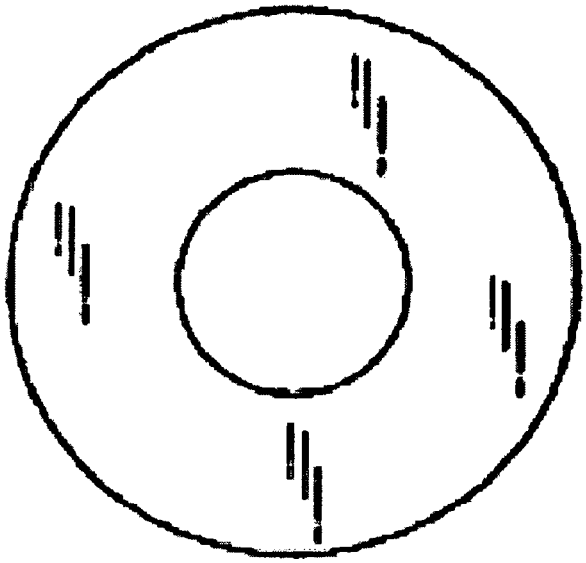
Figure 27C:
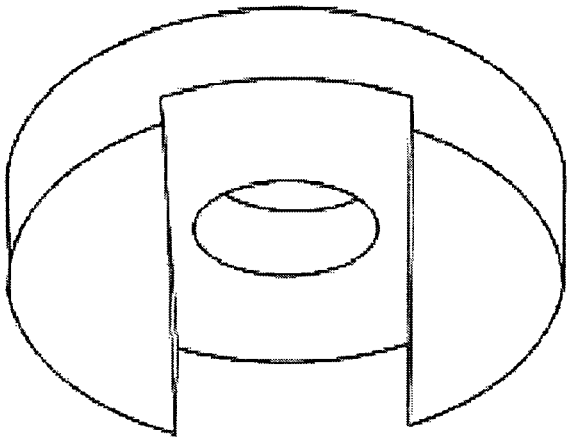
Figure 28:
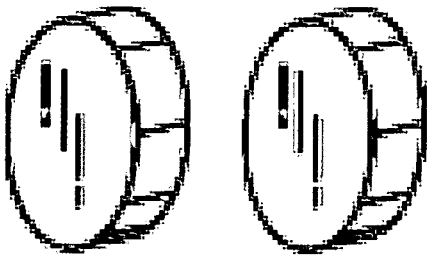
FIG. 28 illustrates an isometric view of the two brake springs.
Figure 29:
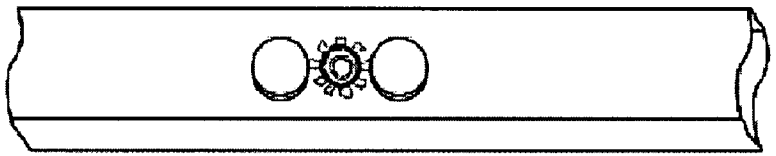
FIG. 29 is a photograph showing the two bake springs mounted to the vertical mast.
Figure 30A:
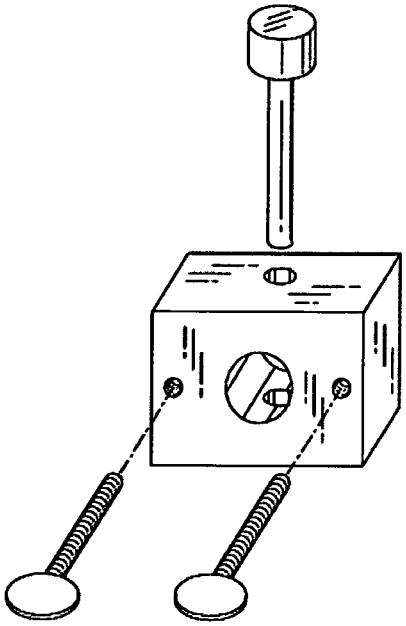
FIG. 30(*a*) illustrates an isometric exploded view of the front brake block.
Figure 30B:
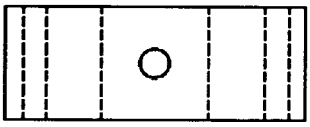
Figure 30C:
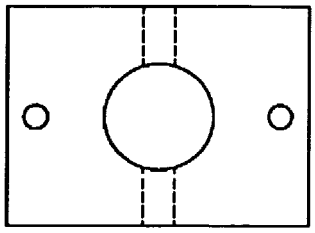
Figure 30D:
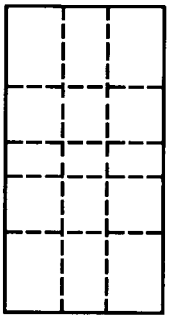

FIG. 21 illustrates a broken exploded cross section of the off-wind axle. FIG. 22 illustrates a cross section of the tracking wheel axle. FIG. 23 illustrates a side elevation of the pinch roll axle and roller. FIG. 24 is a photograph showing the components of the off-wind axle, the tracking wheel axle, and the pinch roll axle and roller arranged as in FIGS. 21, 22, and 23. FIG. 25(*a*) is a photograph showing a side elevation of the off-wind axle completely assembled and mounted on the apparatus. FIG. 25(*b*) is a photograph showing the assembled and mounted off-wind axle from a different viewing angle than FIG. 25(*a*). FIG. 26(*a*) illustrates a rear elevation of the rear brake pad. FIG. 26(*b*) illustrates a front elevation of the rear brake pad. FIG. 26(*c*) illustrates an isometric view of the rear brake pad. FIG. 26(*d*) illustrates a top plan view of the rear brake pad. The brake pad is slotted to engage the vertical mast. The center hole and slot are oversized enough to allow for correcting misalignment. FIG. 27(*a*) is a photograph of the back of the rear brake pad. FIG. 27(*b*) is a photograph of the front of the rear brake pad. FIG. 27(*c*) is a photograph showing the rear brake pad from the top. FIG. 28 illustrates an isometric view of the two brake springs. FIG. 29 is a photograph showing the two bake springs mounted to the vertical mast. They are illustrated in the figures as having cylindrical shapes, but other polyhedrons or solid shapes are feasible.

Figure 31:
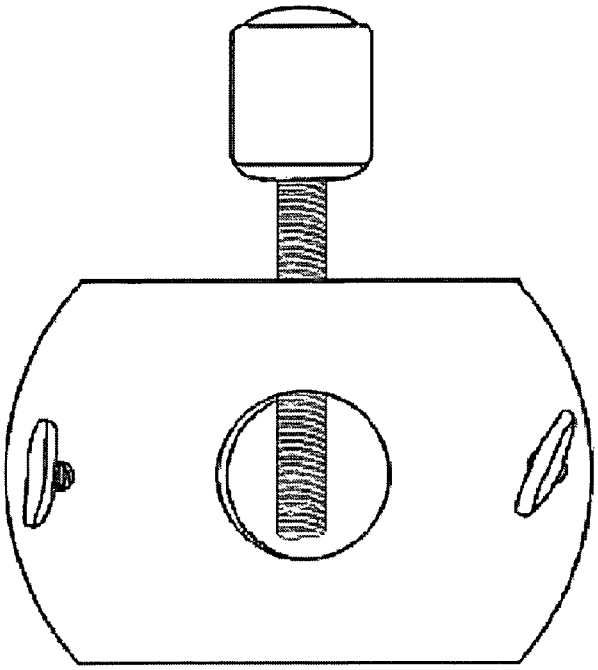
FIG. 31 is a photograph of the front brake block.

FIG. 30(*a*) illustrates an isometric exploded view of the front brake block. FIG. 30(*b*) illustrates a top plan view of the front brake block. FIG. 30(*c*) illustrates a front elevation of the front brake block. FIG. 30(*d*) illustrates a side elevation of the front brake block. FIG. 31 is a photograph of the front brake block. The front brake block is shown in the shape of a rectangular prism, but it can have any practical shape to allow for the alignment pin to drop through the off-wind axle. The alignment pin stops the brake block from rotating and aligns the block perpendicular to the off-wind axle. The axle through hole and the alignment pin through hole are slightly oversized to allow a slight degree of freedom. The thumb screws are used to adjust the brake pressure at the cap plug bushings rim.

Figure 32:
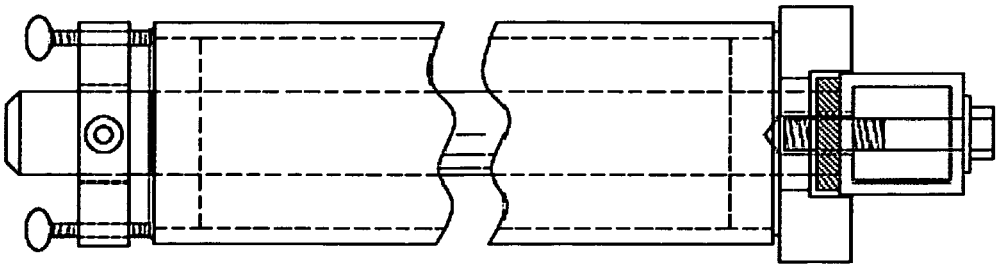
FIG. 32 illustrates a top plan cross section of the off-wind axle, brake pads, brake springs, clearances, mast tube support, cap plug bushings, and axle bolt.
Figure 33:
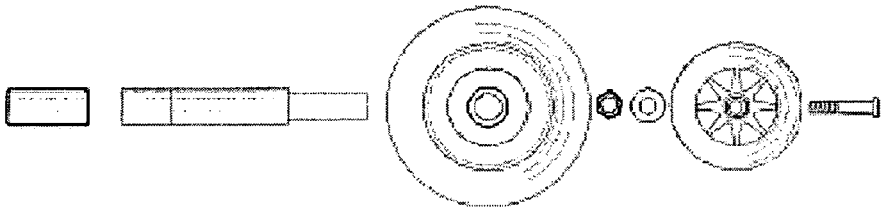
FIG. 33 is a photograph showing the components of the top roller assembly.

FIG. 32 illustrates a top plan cross section of the off-wind axle, brake pads, brake springs, clearances, mast tube support, cap plug bushings, and axle bolt. This is shown in FIG. 25(*b*). FIG. 33 is a photograph showing the components of the top roller assembly.

Figure 34:
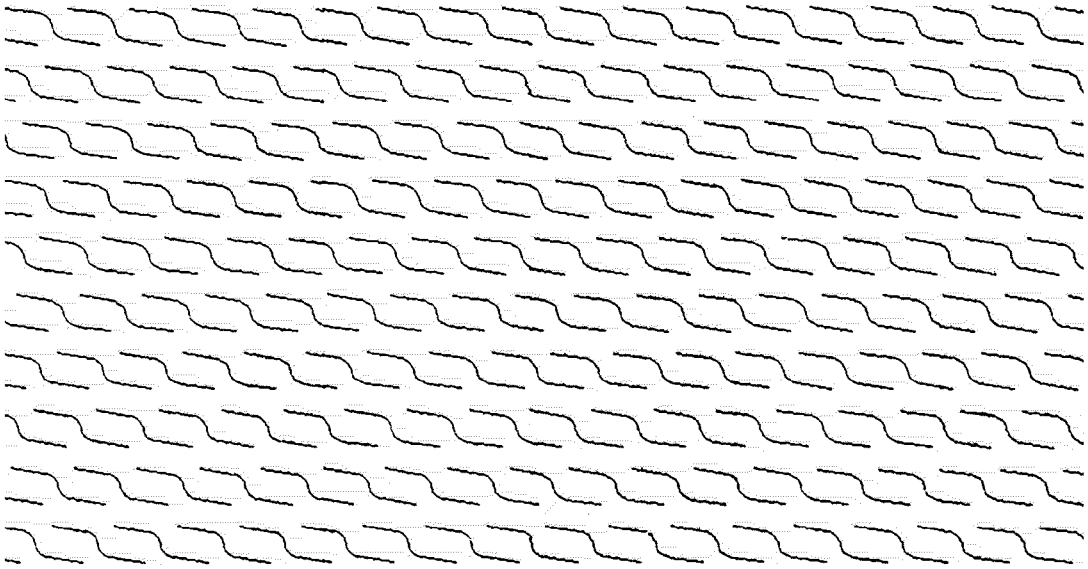
FIG. 34 illustrates a portion of a through-cut web prior to deployment.
Figure 35:
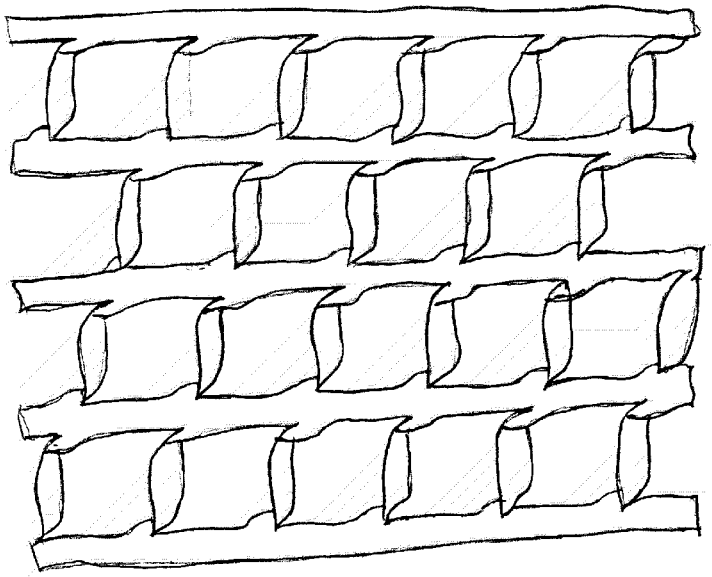
FIG. 35 illustrates a portion of the web after deployment.
Figure 36:
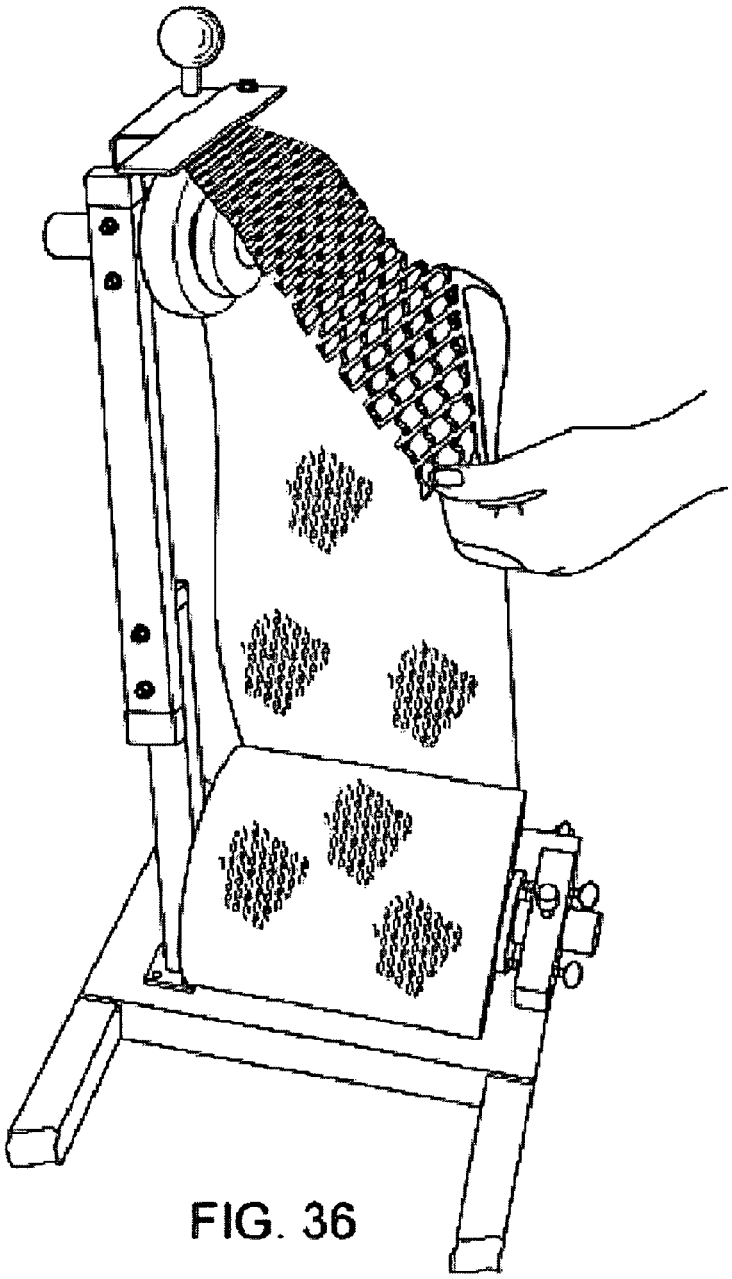
FIG. 36 is a photograph of the apparatus and web as deployment begins.
Figure 37:
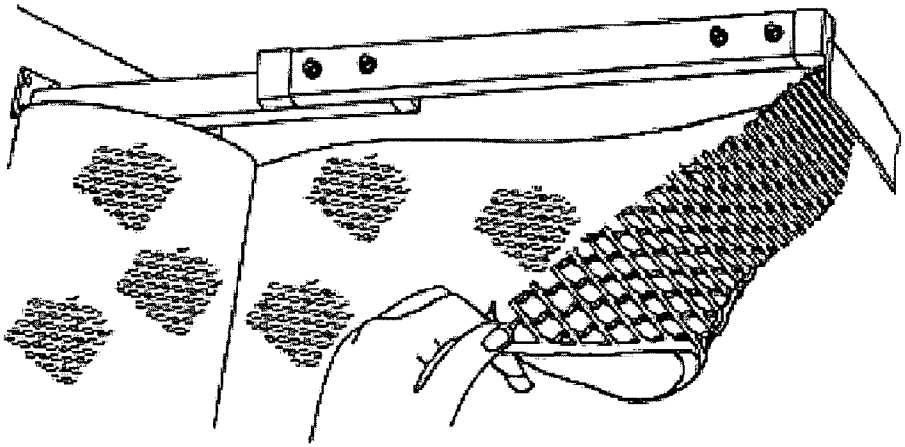
FIG. 37 is a photograph of the apparatus and web during deployment.
Figure 38:
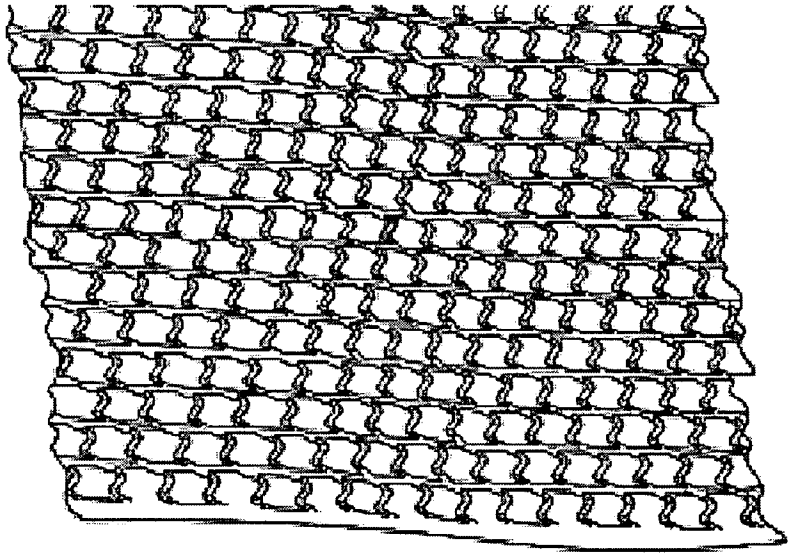
FIG. 38 is a photograph of the web after deployment.

FIG. 34 illustrates a portion of a through-cut web prior to deployment. FIG. 35 illustrates a portion of the web after deployment. FIG. 36 is a photograph of the apparatus and web as deployment begins. FIG. 37 is a photograph of the apparatus and web during deployment. FIG. 38 is a photograph of the web after deployment.

We claim:

1. A dispenser that expands paper web material comprising:

a) a base, said base having the following components:
  (i) two tubes having tube openings;
  (ii) two vinyl end caps that cover said tube openings, respectively;
  (iii) four rubber feet secured to said tubes;
  (iv) four tube extensions to mount two caster wheels having internal bearings;
  (v) two axle bolts for securing the caster wheels, each axle bolt further utilizing a washer and a nut;
  (vi) a base cross tube; and
  (vii) a perpendicular mounting plate base for said mast assembly, b) a mast, c) a cantilevered axle that holds a roll of cut paper web material for off-winding, and d) a roller assembly that controls the tracking of the off-wind paper web material and holds it in place wherein pulling the paper web material in one direction expands it in all directions simultaneously.

2. A dispenser as recited by claim 1, wherein said perpendicular mounting plate base is bent.

3. A dispenser as recited by claim 1, wherein said perpendicular mounting plate base is flat.

4. A dispenser as recited by claim 1, wherein said base components are welded together.

5. A dispenser as recited by claim 1, wherein said base components are bolted together.

6. A dispenser as recited by claim 1 further comprising wheels.

7. A dispenser as recited by claim 1, wherein said mast is attached to said base such that the mast is mounted vertically and perpendicular to the base.

8. A dispenser as recited by claim 1, wherein said mast comprises two welded components:

a vertical tube; and a flange with mounting holes for attachment to said base plate.

9. A dispenser as recited by claim 1, wherein said mast is manufactured as a single bent member.

10. A dispenser as recited by claim 1, wherein said roller assembly is attached horizontally and perpendicularly to the mast assembly at its top.

* * * * *